US011187390B2

(12) United States Patent
van Olst

(10) Patent No.: US 11,187,390 B2
(45) Date of Patent: Nov. 30, 2021

(54) DECORATIVE DECAL DEVICE WITH LIGHT

(71) Applicant: Adfoled International B.V., Wezep (NL)

(72) Inventor: Evert van Olst, Hattern (NL)

(73) Assignee: Adfoled International B.V., Wezep (NL)

( * ) Notice: Subject to any disclaimer, the term of this patent is extended or adjusted under 35 U.S.C. 154(b) by 0 days.

(21) Appl. No.: 16/743,363

(22) Filed: Jan. 15, 2020

(65) Prior Publication Data

US 2020/0224841 A1 Jul. 16, 2020

Related U.S. Application Data

(60) Provisional application No. 62/793,056, filed on Jan. 16, 2019.

(51) Int. Cl.

| | |
|---|---|
| ***F21S 9/02*** | (2006.01) |
| ***F21S 10/04*** | (2006.01) |
| ***F21V 23/00*** | (2015.01) |
| ***F21V 23/04*** | (2006.01) |
| ***B44F 1/06*** | (2006.01) |
| ***F21V 23/02*** | (2006.01) |
| *F21Y 115/10* | (2016.01) |
| *F21W 121/00* | (2006.01) |

(52) U.S. Cl.

CPC ..... *F21S 9/02* (2013.01); *B44F 1/06* (2013.01); *F21S 10/04* (2013.01); *F21V 23/002* (2013.01); *F21V 23/023* (2013.01); *F21V 23/04* (2013.01); *F21W 2121/00* (2013.01); *F21Y 2115/10* (2016.08)

(58) Field of Classification Search

CPC ..... F21S 9/02; F21S 10/04; F21V 23/002; F21V 23/023; F21V 23/04; F21V 21/0808; B44F 1/06; F21W 2121/00; H05K 3/12

See application file for complete search history.

(56) References Cited

U.S. PATENT DOCUMENTS

| | | | | |
|---|---|---|---|---|
| 4,442,478 A * | 4/1984 | Stansbury | F21S 9/02 | 200/60 |
| 5,315,492 A * | 5/1994 | Davenport | A47G 33/00 | 362/122 |
| 5,613,764 A * | 3/1997 | O'Brien | F21S 8/00 | 362/307 |
| 6,013,346 A * | 1/2000 | Lewis | A44C 15/0015 | 156/250 |
| 7,752,790 B1 * | 7/2010 | Michael | G09F 13/22 | 40/544 |
| 8,523,380 B1 * | 9/2013 | Grant | F21V 21/096 | 362/190 |
| 9,297,523 B2 * | 3/2016 | MacKay | F21V 21/0808 | |

(Continued)

*Primary Examiner* — Rajarshi Chakraborty
*Assistant Examiner* — Michael Chiang
(74) *Attorney, Agent, or Firm* — Bookoff McAndrews, PLLC

(57) ABSTRACT

A decal assembly includes a film, a power source including a positive contact and a negative contact, a light having a positive terminal and a negative terminal, and a layer of electrically conductive ink applied to the film, the layer of electrically conductive ink forming a line to connect the positive contact of the power source to the positive terminal of the light, and to connect the negative contact of the power source to the negative terminal of the light.

20 Claims, 12 Drawing Sheets

(56) References Cited

U.S. PATENT DOCUMENTS

| | | | | |
|---|---|---|---|---|
| 10,436,438 | B1 * | 10/2019 | Eagan | B44C 5/0446 |
| 2003/0090889 | A1 * | 5/2003 | Wacyk | H05B 47/19 362/85 |
| 2006/0090384 | A1 * | 5/2006 | Woodruff | G09F 7/12 40/544 |
| 2009/0213586 | A1 * | 8/2009 | Peng | G09F 13/22 362/234 |
| 2012/0092844 | A1 * | 4/2012 | Stone | F21V 21/14 361/771 |
| 2014/0268684 | A1 * | 9/2014 | Waters | F21V 21/084 362/106 |

* cited by examiner

DECORATIVE DECAL DEVICE WITH LIGHT

CROSS-REFERENCE TO RELATED APPLICATIONS

This application claims the benefit under 35 U.S.C. § 119(e) of U.S. Provisional Patent Application No. 62/793,056, filed Jan. 16, 2019, and titled "DECORATIVE LIGHT-UP DECAL," the entirety of which is incorporated herein by reference.

BACKGROUND OF THE INVENTION

Field of the Invention

The present invention relates to a decorative decal device with a light.

Description of the Related Art

Decorative window lights are frequently used during the holiday season. Such window lights typically include a base, a tube having a lower end connected to the base, and a bulb mounted to an upper end of the tube. The base and the tube are typically formed of a plastic material. A wired window candle includes a cord having a plug at one end thereof for connection to a typical residential electrical outlet, to supply power to the bulb. Due to limited lengths of the cords, conventional wired window candles require placement close to an outlet within a residence. Alternatively, a battery may be used, instead of a cord, to supply power to the bulb. A battery-powered window light has the benefit of not requiring placement close to an outlet within a residence.

Both types of window lights require placement on a surface of a window sill, or a similar surface, having an area that is large enough to support the base of the window light. In addition, due to the likelihood of the conventional window lights being accidentally knocked off the window sill, these devices typically require a device for securing the window light to the window sill, such as a tie, in order to prevent damage that may occur if the window light falls, e.g., breaking of the bulb.

In addition, conventional window lights and window candles are fire-risks, and are generally not permitted in certain dwellings, such as nursing homes, hospitals, schools, etc. Accordingly, there is a desire for a safe, easy-to-install light-up window decoration.

The decorative decal device of the present invention avoids the above-described problems with conventional window lights.

DETAILED DESCRIPTION OF EMBODIMENTS

A detailed description of embodiments of a decorative decal device 100 is provided with reference to the drawings.

Figure 1:
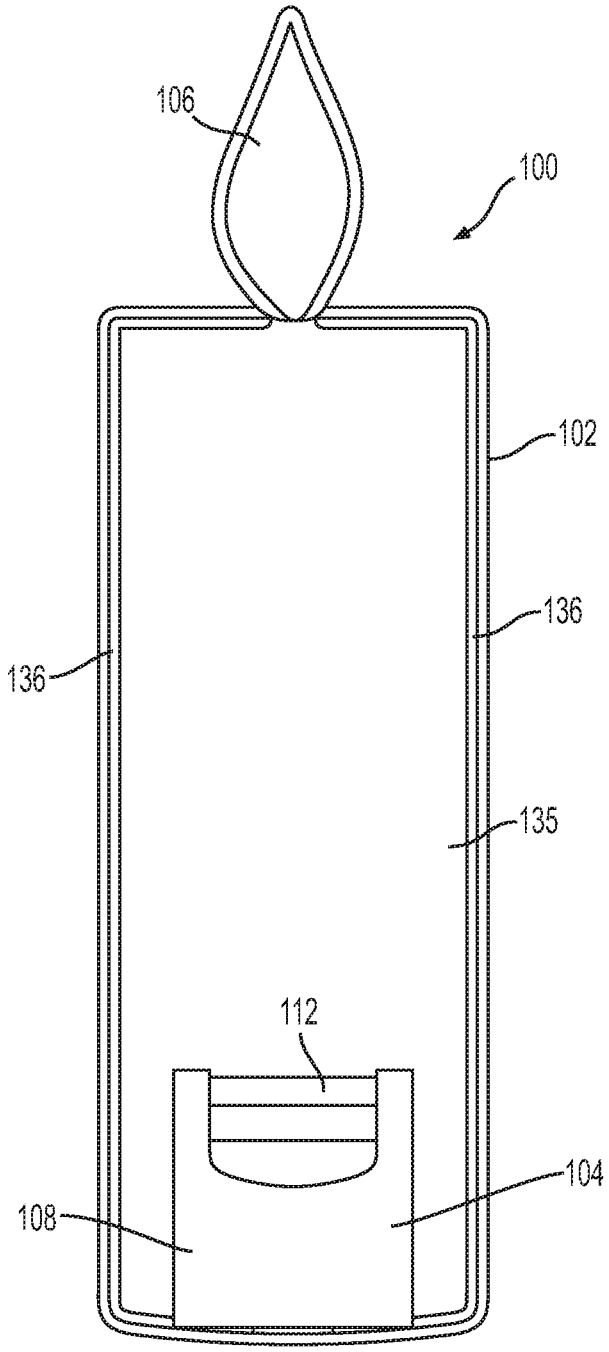
FIG. 1 is a schematic view of a decal device according to the invention.
Figure 2:
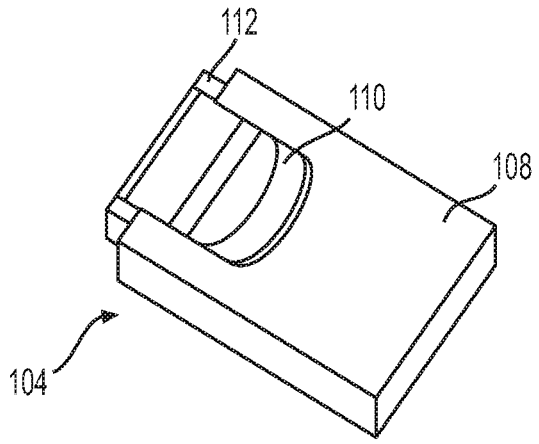
FIG. 2 is an isometric view of a battery portion of the decal device.
Figure 3:
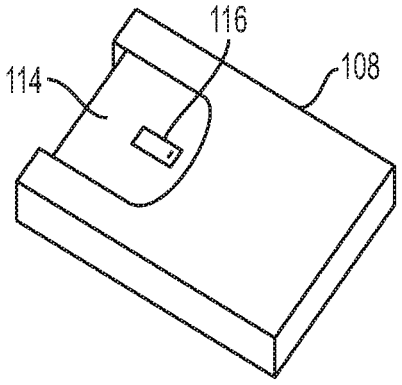
FIG. 3 is an isometric view of a pocket of the battery portion.

As shown in FIG. 1, a foil or a film 102 serves as a base of the decal device 100. Preferably, the film 102 is transparent, with an image formed (i.e., printed) thereon. The film 102 may be formed, for example, of a polyethylene terephthalate (PET) thermoplastic polymer resin, or a coated polyester film, and may, for example, have a gross thickness of 0.15 mm, when mounted to a cover sheet, and a net thickness of 0.11 mm, when not mounted to the cover sheet. The cover sheet provides a protective backing on the application side of the film 102, and is preferably removed immediately before applying the film 102 to a surface. The film 102 may have a glossy finish. The particular material used, and the particular thickness of the film 102 may vary. The film 102 has an application side configured to be applied to a smooth surface, such as a glass surface, e.g., a window, a smoothly painted surface, or a plastic surface, by micro suction technology (i.e., without the use of glue). Alternatively, the application side of the film 102 may be applied to a smooth surface using glue, e.g., a small amount of glue is applied to the application side. The film 102 also has a non-application side, on which a battery portion 104 and a light portion 106 are provided. The battery portion 104 and the light portion 106 may be attached to the non-application side of the film 102 using an adhesive, e.g., a glue. In the embodiment shown in FIG. 1, the film 102 is shaped as a candle. Other shapes may, however, be used, as described below.

Figure 4:
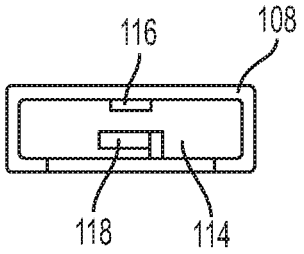
FIG. 4 is a top view of the pocket of the battery portion.
Figure 5:
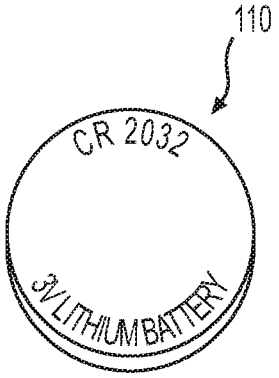
FIG. 5 is an isometric view of a battery of the battery portion.

As shown in FIGS. 2 to 7, the battery portion 104 is provided toward a lower end of the film 102, and includes a pocket 108, or a base portion, to hold a battery 110, as a power source, and a slidable cap 112. The pocket 108 may be formed of a plastic material, for example. The pocket 108, shown in FIG. 3, includes a slot 114 into which the battery 110 and the cap 112 may be inserted. As shown in FIG. 4, the pocket 108 also includes a positive battery contact 116 and a negative battery contact 118. The positive battery contact 116 and the negative battery contact 118 may be formed of copper, for example. The material used to form the positive battery contact 116 and the negative battery contact 118 is not limited, however, to copper, and may be any suitable electrically conductive material. The battery 110, shown in FIG. 5, may be a button battery. More specifically, for example, the battery 110 may be a single-use, lithium button cell CR2032 3-volt battery. The battery 110 may include a timer that maintains an ON state of the decal device 100, for example, for 6 hours, before changing to an OFF state. The battery 110 may be approximately 28.5 mm×34 mm×8 mm in size. The battery 110 may be formed of a glass fiber reinforced epoxy resin. The battery portion 104 is preferably the same color as the portion of the image on which the battery portion 104 is glued. A solar cell may be incorporated in place of the battery, as an alternate power source.

Figure 6:
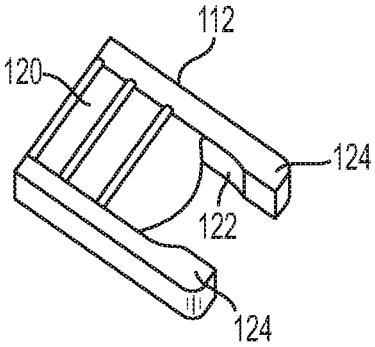
FIG. 6 is an isometric top view of a cap of the battery portion.
Figure 7:
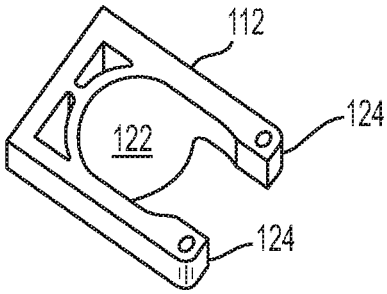
FIG. 7 is an isometric bottom view of the cap of the battery portion.

The cap 112, as shown in FIG. 6, includes an upper, ridged surface 120, a slot 122, and two arms 124. The ridged surface 120 of the cap 112 is provided so as to nest within the slot 114 of the pocket 108, with the ridges allowing a user to firmly slide the cap 112 in and out of the pocket 108. As shown in FIG. 7, the slot 122 of the cap 112 is generally shaped to receive a battery. In this embodiment, the slot 122 is shaped to receive the button cell battery. The slot 122 may, however, be shaped to receive another type of battery.

Figure 8:
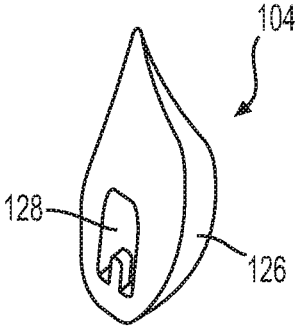
FIG. 8 is an isometric view of a cover of a light portion of the decal device.
Figure 9:
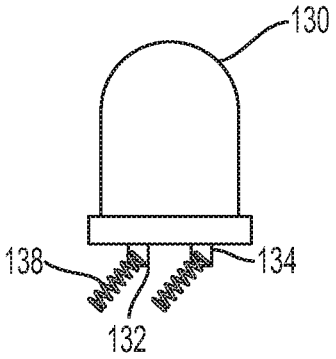
FIG. 9 is an isometric view of a light-emitting diode (LED) of the light portion.

The light portion 106 is provided at an upper portion of the film 102, and, as shown in FIG. 8, includes a cover 126 formed of a resin material or silicon, for example. In the embodiment shown in FIGS. 1 and 8, the cover 126 is generally shaped like a candle flame. Preferably, the color of the cover 126 is transparent white. The shape of the cover 126 is not, however, limited to a candle flame, and may be, for example, a star. The cover 126 is preferably formed of a transparent plastic using a mold. The cover 126 includes a pocket 128, and the light portion 106 further includes a light-emitting diode (LED) 130 that is nested within the pocket 128. The LED 130, shown in FIG. 9, includes a positive terminal 132 and a negative terminal 134. The LED 130 preferably has an inner size of 14 mm×6.5 mm×6.5 mm, and an outer size of 35 mm×16 mm×9 mm. In addition, the LED 130 is preferably a yellow flicker type LED.

Figure 12:
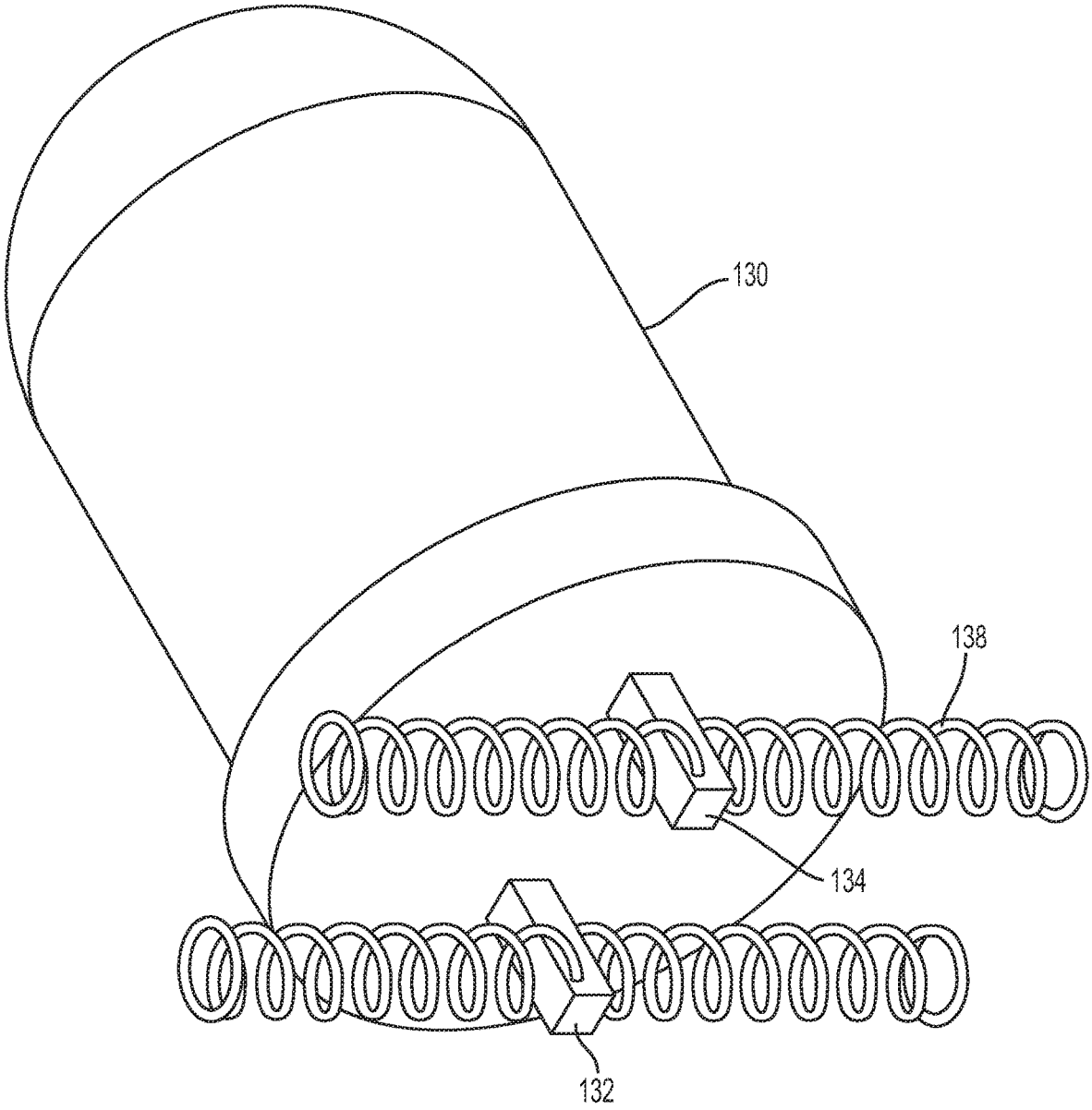
FIG. 12 is an isometric view of the LED and springs provided on the LED.

On the non-application side of the film 102, a combination of non-conductive ink 135, depicting the image of the decal device 100, and an electrically conductive ink (ECI) 136, which forms a part of an electrical circuit, are applied, for example, using printing, as will be described below. More specifically, with reference to FIG. 10, the ECI is applied so as to form a line connecting the positive battery contact 116 to the positive terminal 132 of the LED 130, and to form a line connecting the negative battery contact 118 to the negative terminal 134 of the LED 130. The positive terminal 132 and the negative terminal 134 of the LED 130 may connect to the ECI 136 using miniscule springs 138, as shown in FIG. 12, that press on spots, or part of the line, formed by the ECI 136. The springs 138 may be formed of copper, for example. The material used to form the springs 138 is not, however, limited to copper, and may be any suitable electrically conductive material. The springs 138 are pushed over or into nodes of the LED 130, as shown in FIG. 12. As a result of the spring force of the springs 138, the springs 138 constantly contact the spots of the ECI 136, ensuring a successful connection for the electrical circuit. Similarly, the positive battery contact 116 and the negative battery contact 118 of the battery portion 104 connect the battery 110 to the ECI 136, with the positive battery contact 116 and the negative battery contact 118 being formed as copper tabs that contact the ECI 136. The material used to form the positive battery contact 116 and the negative battery contact 118 is not, however, limited to copper, and may be any suitable electrically conductive material. In addition, the copper tabs may be in the form of springs.

Figure 11:
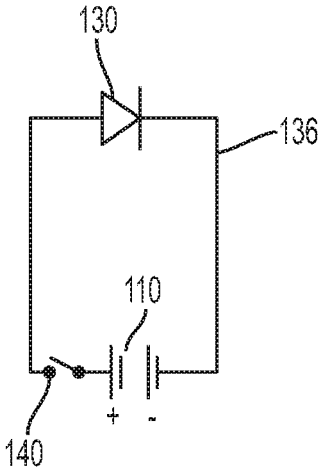
FIG. 11 is an equivalent circuit formed by the battery, electrically conductive ink (ECI), and the LED of the decal device according to the invention.

FIG. 11 shows an equivalent circuit formed by the battery 110, the ECI 136, and the LED 130. The equivalent circuit includes a switch 140, representing the operability of the pocket 108 for the battery 110. That is, when the battery 110 is placed in the cap 112, and the cap 112 and the battery 110 are inserted into the slot 114 of the pocket 108, the switch 140 is closed, and voltage is supplied from the battery 110 to the LED 130 via the ECI 136. When the battery 110 and the cap 112 are removed from the slot 114 of the pocket 108, the switch 140 is opened, and the voltage is not supplied to the LED 130.

By virtue of the present invention, a printed foil or film with a light-up, three-dimensional design (e.g., a light-up candle, ornament, etc.) can be provided. In addition, a user can easily operate the light portion 106 of the decal device 100 by sliding the battery 110 and the cap 112 into or out of the slot 114 of the pocket 108. The battery 110 can be easily replaced. When the user fully inserts the cap 112 and the battery 110 into the slot 114 of the pocket 108, current flows from the battery 110, through the positive battery contact 116, the lines of ECI 136, the positive terminal 132 of the LED 130, and, therefore, causes the LED 130 to emit light. The LED 130 causes the cover 126 to glow, and thus accentuates the image formed on the film 102.

Figure 13:
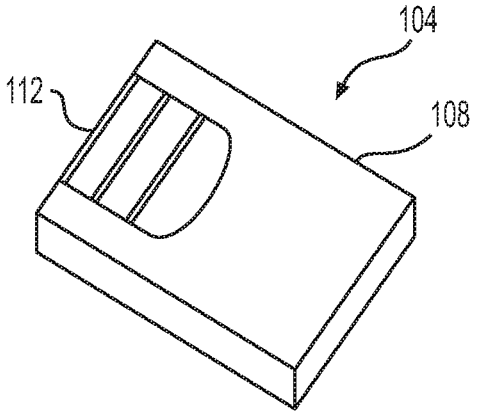
FIG. 13 is an isometric external view of the battery portion in an on state
Figure 14:
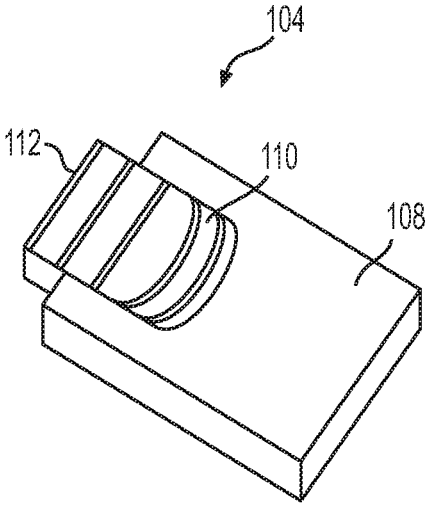
FIG. 14 is an isometric external view of the battery portion in an off state.
Figure 15:
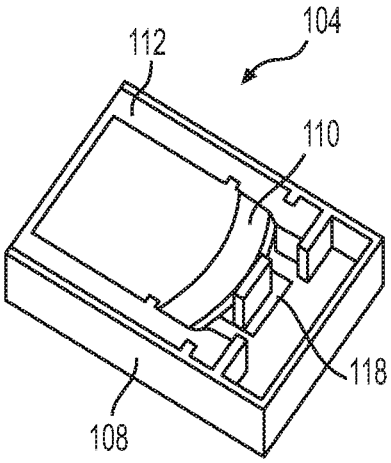
FIG. 15 is an isometric internal view of the battery portion in the on state.
Figure 16:
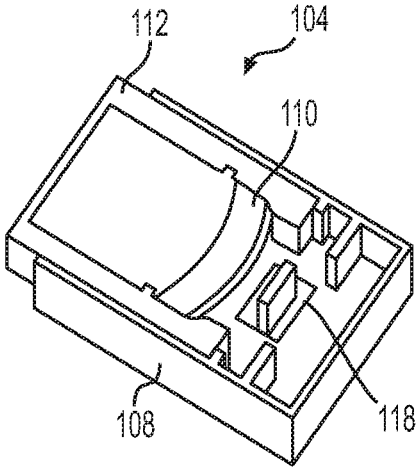
FIG. 16 is an isometric internal view of the battery portion in the off state.

FIGS. 13 to 16 show on and off states of the battery portion 104 of the decal device 100. In particular, FIG. 13 shows an external view of the battery portion 104 in an on state, in which the cap 112 is fully inserted into the slot 114 of the pocket 108. FIG. 14 shows an external view of the battery portion 104 in an off state, in which the cap 112 and the battery 110 are not fully inserted into the slot 114 of the pocket 108. FIG. 15 is an internal view of the battery portion 104 in an on state, in which the cap 112 and the battery 110 are fully inserted into the slot 114 of the pocket 108. As shown, the battery 110 contacts the negative battery contact 118 in this state. The battery 110 also contacts the positive battery contact 116, although in the view shown in FIG. 15, the positive battery contact 116 is obscured by the cap 112 and the battery 110. FIG. 16 is an internal view of the battery portion in the off state, in which the cap 112 and the battery 110 are not fully inserted into the slot 114 of the pocket 108. As shown in FIG. 16, the battery 110 does not contact the negative battery contact 118. Alternatively, an "on-off" switch can be provided in the battery portion 104, permitting the cap 112 and the battery 110 to remain fully inserted into the pocket 108, or a light-sensitive switch can be provided instead of the on-off switch.

Figure 17:
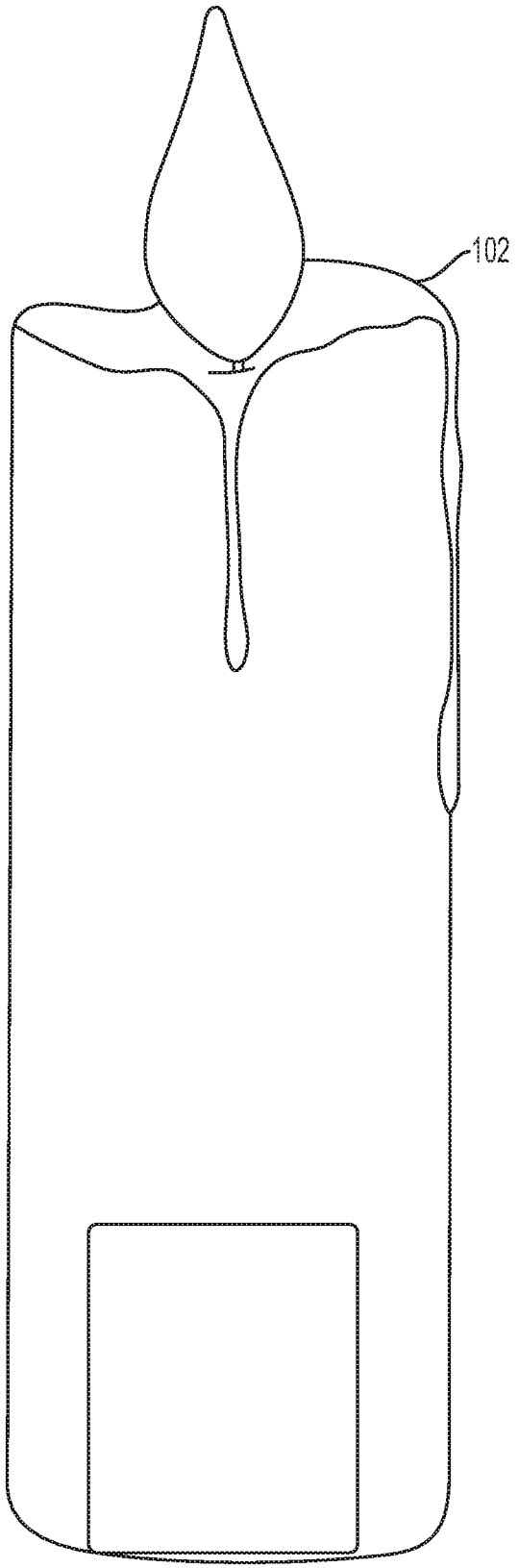
FIGS. 17 to 19 depict alternative images and shapes of a film of the decal device, according to alternative embodiments of the invention.
Figure 18:
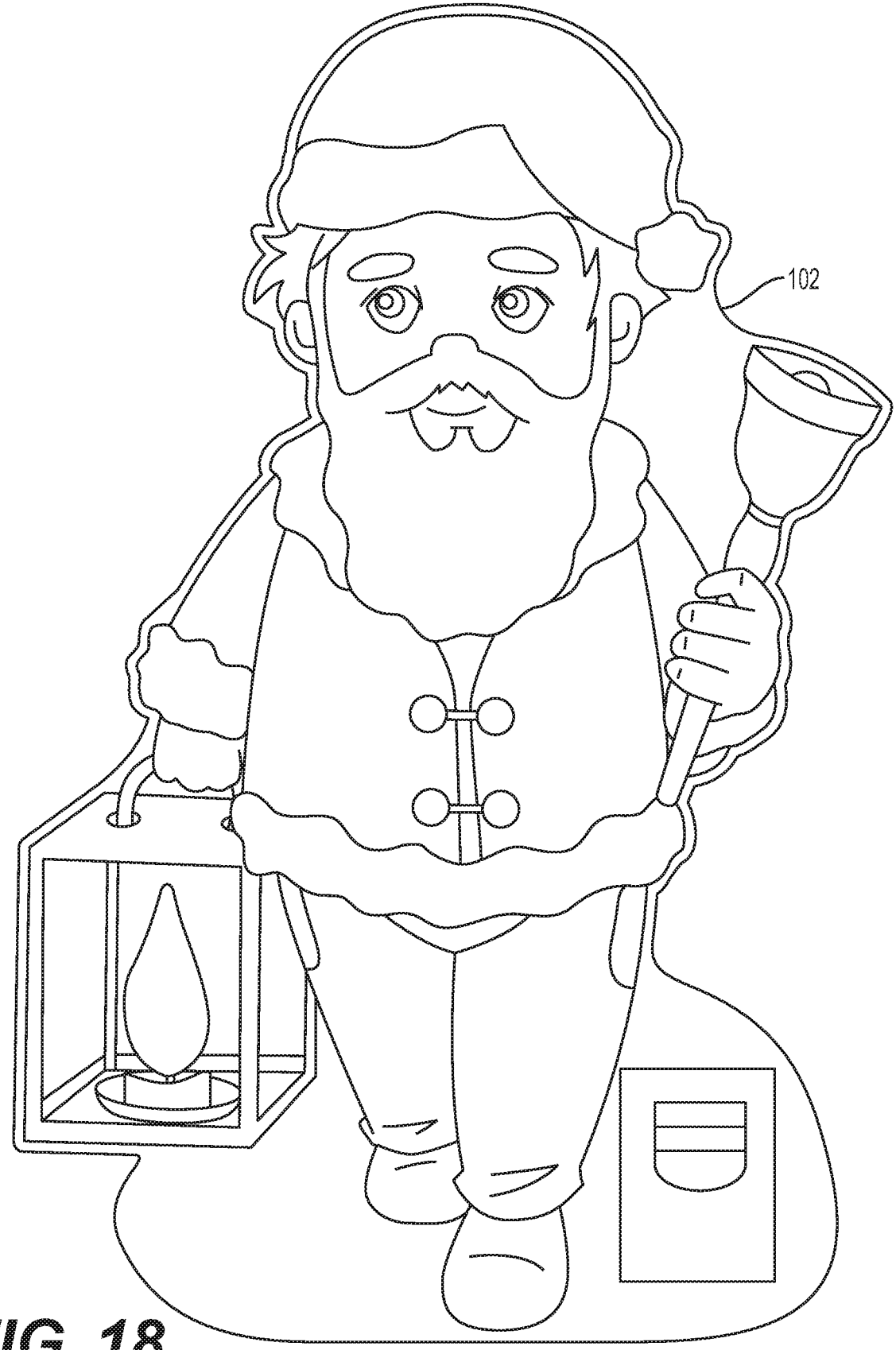
Figure 19:
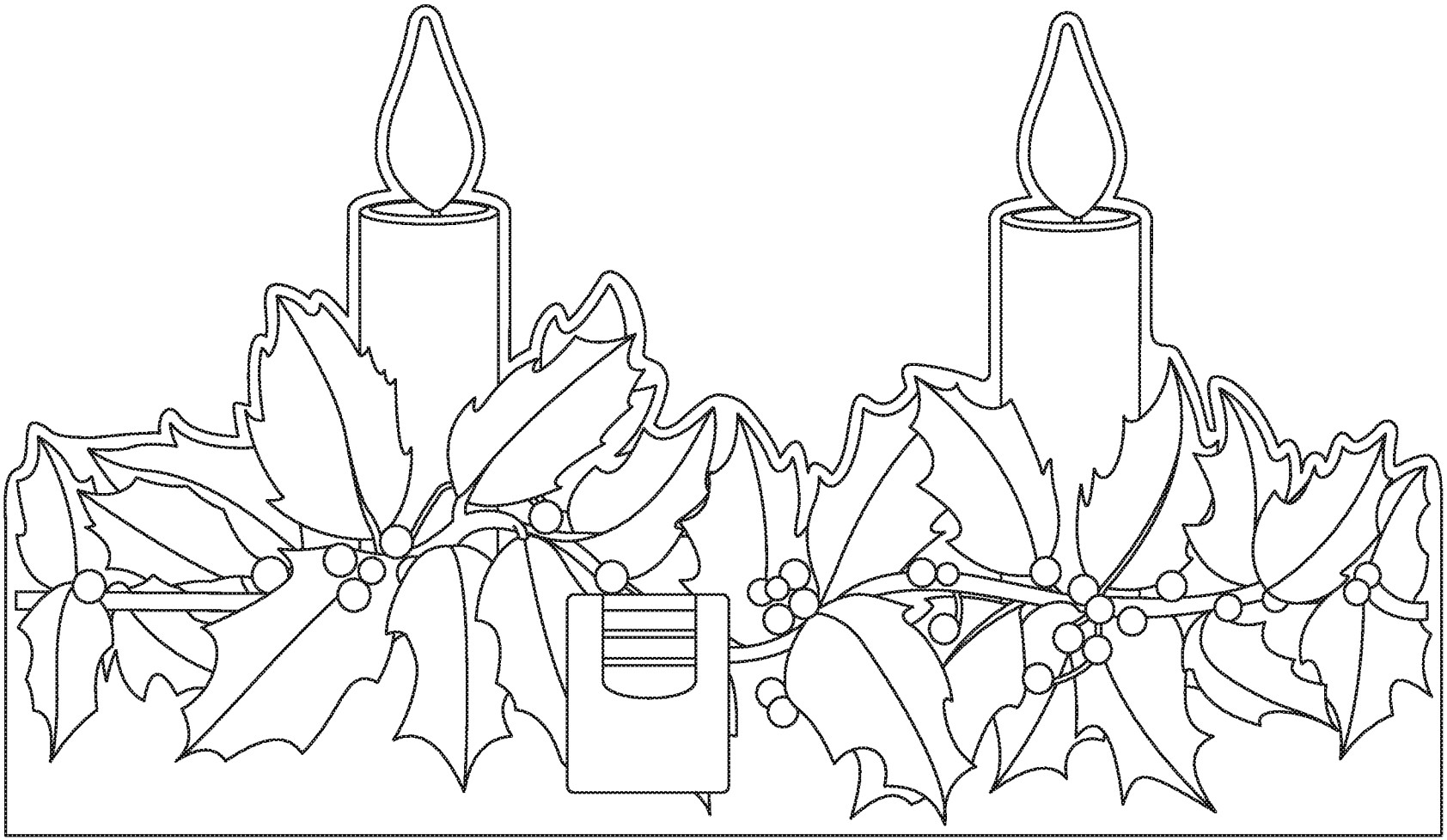

FIGS. 17 to 19 show alternative embodiments, and, in particular, show alternative images and shapes of the film 102. As shown in FIG. 17, the film 102 may be shaped like a candle, as in the embodiment described above. The embodiment shown in FIG. 17 differs, however, in that the candle, as printed on the film 102, may be a color, e.g., red. In addition, the film 102 may be shaped to include protrusions that depict wax dripping on the candle. In FIG. 18, the film 102 is shaped as Santa Claus carrying a bell and a lantern. In FIG. 19, the film 102 is shaped as a bough of holly with two candles protruding from the bough. In other unshown embodiments, the film 102 may be formed with images, and in corresponding shapes, of stars, pine branches, snow edges, Christmas ornaments, Santa Claus on a sled, and any other Christmas-related images. In addition, the film 102 may be formed with images, and in corresponding shapes, of hearts, a fire engine, a plane, a car, a bus, a truck, flowers, a gnome, a fairy, occasional banners, or any other image.

The images, which are created by the non-conductive ink, may be formed on the film 102 by printing. For example, the images may be formed using digital printing, or screen-printing. The inks used for printing images on the film 102 are preferably color-fast and light-fast inks. The inks may be transparent or opaque. The ECI 136 is also printed on the film 102 using one of the above-listed methods. Preferably, the ECI 136 is printed in a continuous line around a perimeter of the image.

Figure 20:
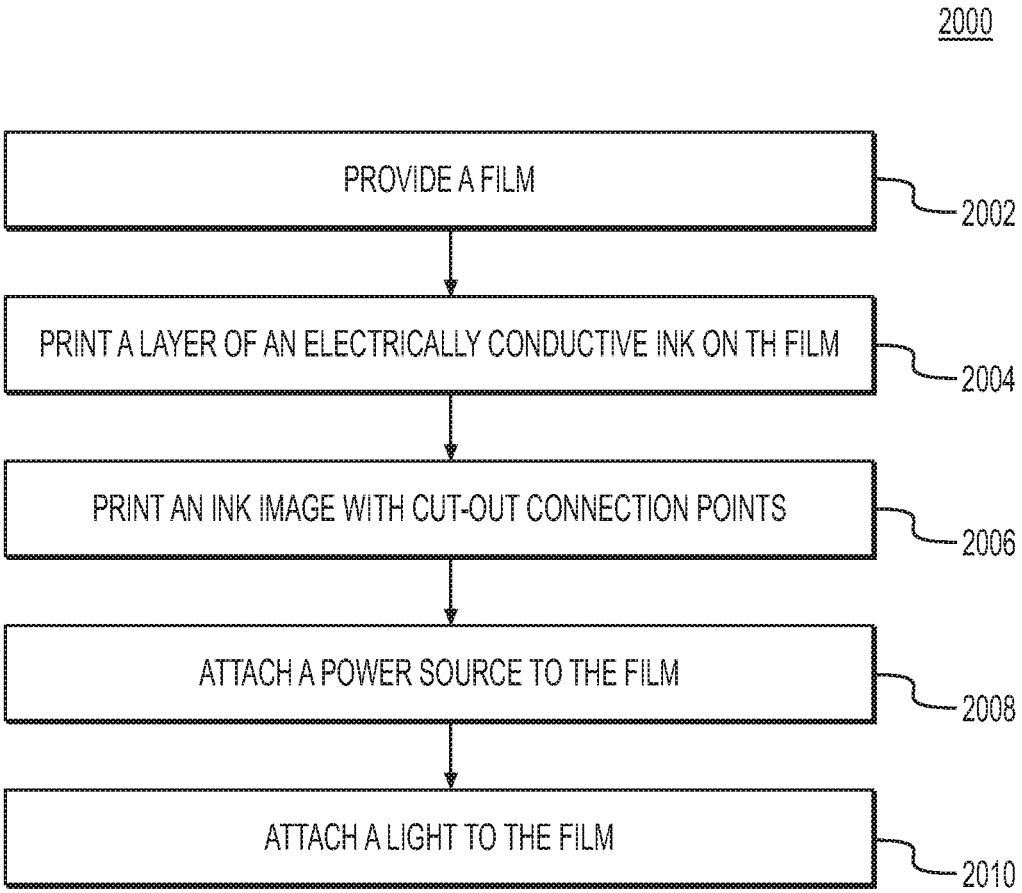
FIG. 20 includes a flowchart showing a process of manufacturing the decal device.

FIG. 20 includes a flowchart showing a process 2000 of manufacturing the decal device 100. In step 2002, a film 102 having an application side, for application to a surface, and a non-application side, is provided. In step 2004, a layer of the ECI 136 is printed on either the application side or the non-application side of the film 102. Then, in step 2006, an ink image is printed with cut-out connection points, on the same side of the film 102 on which the ECI 136 was printed. In step 2008, a power source, which may include the battery portion 104, is attached to the film 102, on the same side of the film 102 on which the ECI 136 was printed. Positions of the contacts 116 and 118 of the power source should be aligned with the cut-out connection points of the ink image, so that the contacts 116 and 118 of the power source contact the ECI 136 through the cut-out connection points. In step 2010, the light portion 106 is attached to the film 102, on the same side of the film 102 on which the ECI 136 was printed. Positions of the terminals 132 and 134 of the light portion 106 should be aligned with other cut-out connection points of the ink image, so that the terminals 132 and 134 of the light portion 106 contact the ECI 136 through the other cut-out connection points. As a result of this process 2000, a decal device 100 is formed.

Figure 21A:
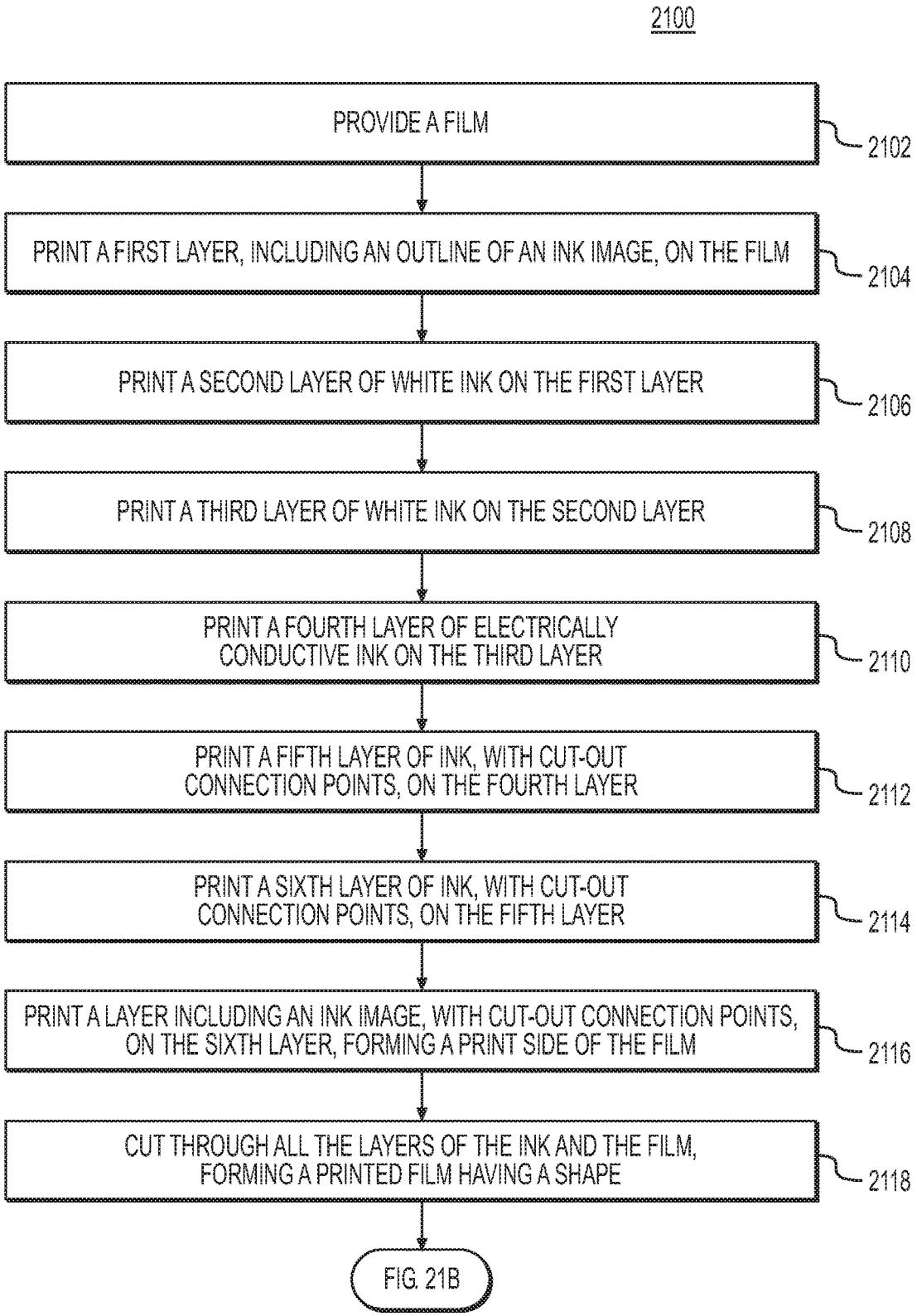
FIGS. 21A and 21B include a flowchart showing a process of manufacturing the decal device according to an alternative embodiment.

The process 2000 is not, however, limited to the above noted steps. Additional steps may be included in the process, as in an alternative process 2100, described with reference to FIGS. 21A and 21B. As shown in FIG. 21A, in step 2102, a film 102 having an application side, for application to a surface, and a non-application side, is provided. In step 2104, a first layer, including an image, is printed on the non-application side of the film 102. In step 2106, a second layer of white ink is printed on the first layer. In step 2108, a third layer of white ink is printed on the second layer. In step 2110, a fourth layer of ECI 136 is printed on the third layer, thereby forming a layer of ECI 136. In step 2112, a fifth layer of ink, with cut-out connection points, is printed on the fourth layer of the ECI 136. In step 2114, a sixth layer of ink, with cut-out connection points, is printed on the fifth layer. Then, in step 2116, a seventh layer including an ink image, with cut-out connection points, is printed on the sixth layer, thereby forming a print side of the film 102.

Figure 10:
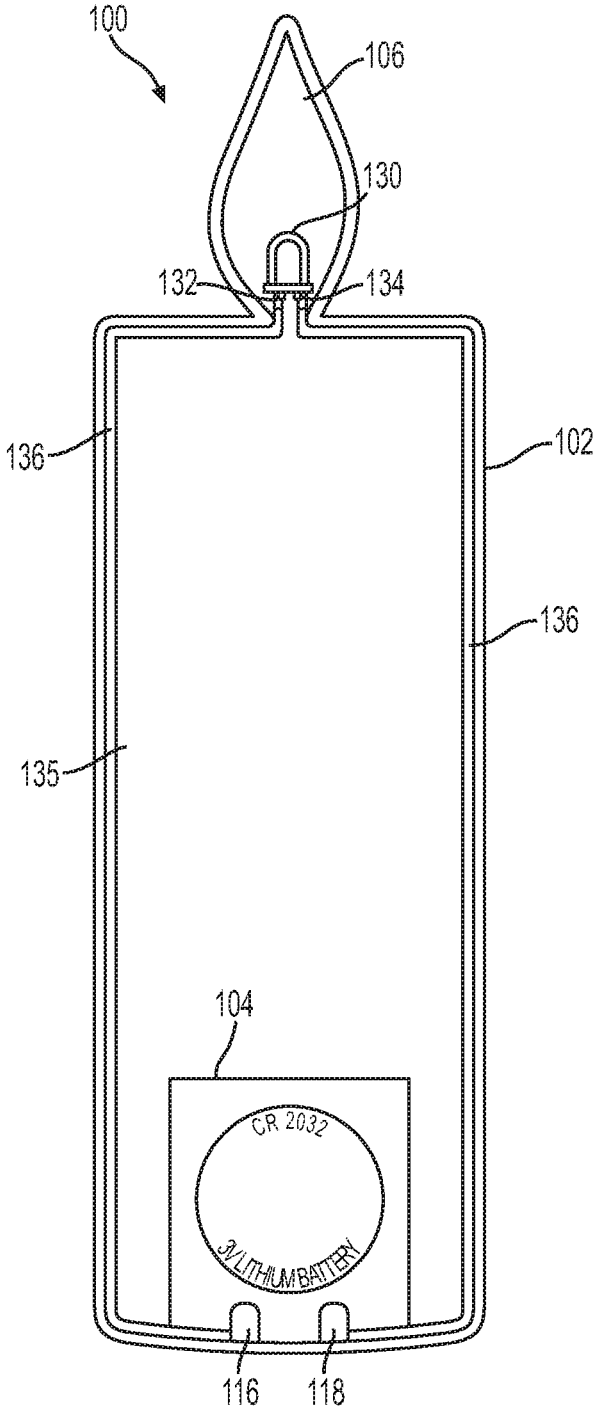
FIG. 10 is a schematic view of the decal device according to the invention.

In step 2118, cutting is performed through all layers of the ink and the film 102, to produce a decal device 100 having a particular shape, e.g., a shape of a candle, as shown in FIGS. 1, 10, and 17, a shape of Santa Claus, as shown in FIG. 18, or a shape of garland with candles, as shown in FIG. 19. In one embodiment, an initial step of cutting through a top layer of the film, around the image, is performed in order to facilitate removal of the decal from the cover sheet, and a second step of cutting through the film and the cover sheet is performed. If, for example, the image is a candle, the outer size of the film 102 following the cutting process is approximately 705 mm×120 mm, with the image being centered. The size of the film may vary, however, depending on the image depicted.

Figure 21B:
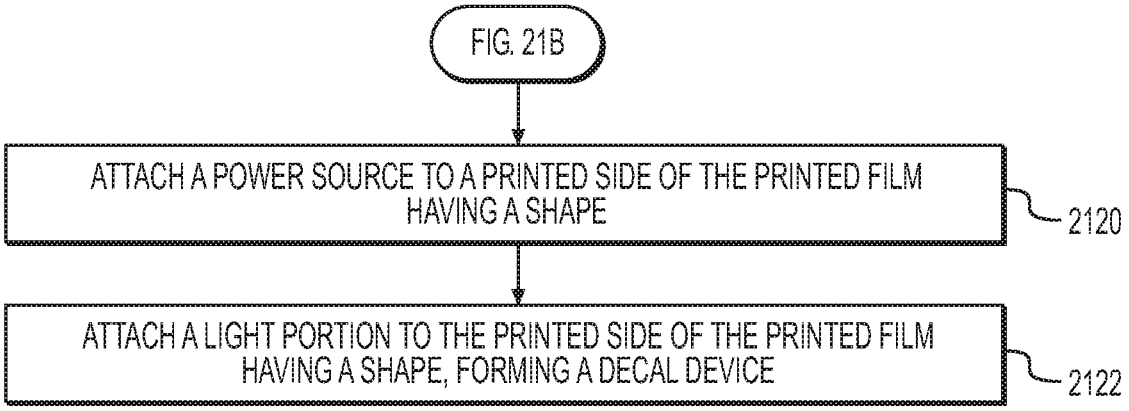

With reference to FIG. 21B, the process 2100 continues with step 2120, in which a power source is attached to the film 102, such that a position of the contacts 116 and 118 of the power source align with the cut-out connection points of the layers of ink, and contact the ECI 136. In the step of attaching the power source, glue may be used to attach the power source to the film 102. The battery portion 104, for example, as the power source, is provided straight and flat on the film 102, such that no glue residues are visible on the image or on the battery portion 104, and such that no glue residue exists on contact points (i.e., the positive battery contact 116 and the negative battery contact 118 of the battery portion 104) and the copper tab portions.

In step 2122, a light portion 106 is attached to the film 102. Glue may be used to attach the light portion 106 to the film 102. The cover 126 of the light portion 106 is provided straight and flat on the film 102, such that no glue residue exists on contact portions (i.e., the positive terminal 132 or the negative terminal 134 of the LED 130) and the springs 138. The light portion 106 is preferably glued well around, such that the light portion 106 is secured to the film 102 without glue residue being visible on the image. As the cover 126 is formed of a resin material, the cover 126 is preferably gently pressed onto the film 102, so as not to change the shape of the cover 126 during the process of attaching the light portion 106. In addition, the springs 138, which are provided to connect the positive terminal 132 and the negative terminal 134 of the LED 130 to the ECI 136, must be placed exactly on the cut-out connection points to ensure electrical connection between the positive terminal 132 and the ECI 136, and the negative terminal 134 and the ECI 136. As a result of this process 2100, a decal device 100 is formed.

The decal device 100 may be provided with a frame (not shown), or without a frame.

Although the embodiments described above provide for one or two LEDs 130, the decal device 100 may be provided with three or more LEDs 130. The LED (or LEDs) 130 may be configured to flicker when the switch 140 is closed. The LED 130 may be provided with a wide beam angle. The LED 130 may be, for example, a surface-mount LED (i.e., an SMD LED), a round LED having a diameter of 3 mm or 5 mm, or a flat LED.

While the invention has been described as including a button battery as a power source, the power source may alternatively be a battery that is held in an external battery holder, or an adapter connected to a residential power outlet. The adapter may be a 230V-3V adapter, or a 24/12V-3V adapter. In addition, while the button battery is described as a singular button battery, the power source may include multiple button batteries. A penlight battery may also be used, and, in such an embodiment, an external battery holder may be provided for the penlight battery.

While the present invention has been described with reference to exemplary embodiments, it is to be understood that the invention is not limited to the disclosed exemplary embodiments. Indeed, the invention encompasses all modifications and equivalent structures and functions.

I claim:

1. A decal assembly comprising:

a film;

a power source including a positive contact and a negative contact;

a light having a positive terminal and a negative terminal;

a layer of electrically conductive ink applied to the film, the layer of electrically conductive ink forming a line to connect the positive contact of the power source to the positive terminal of the light, and to connect the negative contact of the power source to the negative terminal of the light; and at least one additional layer of ink, the at least one additional layer of ink including a plurality of cut-out connection points, the at least one additional layer of ink extending between the cut-out connection points;

wherein the positive terminal of the light is aligned with a first cut-out connection point of the plurality of cut-out connection points, and the negative terminal of the light is aligned with a second cut-out connection point of the plurality of cut-out connection points so that the at least one additional layer of ink extends between the first and the second cut-out connection points.

2. The decal assembly according to claim 1, wherein the power source further includes:

a base portion having a recess, the base portion being attached to the film; and a cap configured to be inserted into the recess of the base portion to secure the battery within the base portion.

3. The decal assembly according to claim 2, wherein the light is a light-emitting diode.

4. The decal assembly according to claim 3, wherein the positive contact, the negative contact, the positive terminal, and the negative terminal are springs.

5. The decal assembly according to claim 3, wherein the positive contact, the negative contact, the positive terminal, and the negative terminal are formed of copper.

6. The decal assembly according to claim 3, wherein the power source further includes an on-off switch configured to switch a state of the power source between an on state, in which power is supplied to the light, and an off state, in which power is not supplied to the light.

7. The decal assembly according to claim 3, wherein the power source further includes a timer configured to switch a state of the power source between an on state, in which power is supplied to the light, and an off state, in which power is not supplied to the light.

8. The decal assembly according to claim 1, wherein the decal assembly includes an ink image, the ink image being an image of a candle, and the light having a three-dimensional shape corresponding to a flame of the candle.

9. The decal assembly according to claim 1, wherein one side of the film is configured to be applied to one or more of a glass surface, a painted surface, or a plastic surface, by micro suction.

10. A method of manufacturing a decal assembly, the method comprising:

providing a film;

printing a layer of an electrically conductive ink on the film;

printing an ink image with a plurality of cut-out connection points, after printing the layer of the electrically conductive ink;

attaching a power source to the film, the power source including a positive contact and a negative contact; and attaching a light to the film, the light having a positive terminal and a negative terminal, wherein the layer of electrically conductive ink forms a line to connect the positive contact of the power source to the positive terminal of the light, and to connect the negative contact of the power source to the negative terminal of the light; and wherein the positive terminal is aligned with a first cut-out connection point of the plurality of cut-out connection points, and the negative terminal is aligned with a second cut-out connection point of the plurality of cut-out connection points so that the ink image extends between the first and the second cut-out connection points.

11. The method according to claim 10, wherein the power source further includes:

a base portion having a recess, the base portion being attached to the film;

and a cap configured to be inserted into the recess of the base portion to secure a battery within the base portion.

12. The method according to claim 11, wherein the light is a light-emitting diode.

13. The method according to claim 12, wherein the positive contact, the negative contact, the positive terminal, and the negative terminal are springs.

14. The method according to claim 12, wherein the positive contact, the negative contact, the positive terminal, and the negative terminal are formed of copper.

15. The method according to claim 12, wherein the power source further includes an on-off switch configured to switch a state of the power source between an on state, in which power is supplied to the light, and an off state, in which power is not supplied to the light.

16. The method according to claim 12, wherein the power source further includes a timer configured to switch a state of the power source between an on state, in which power is supplied to the light, and an off state, in which power is not supplied to the light.

17. The method according to claim 10, further comprising printing, before printing the layer of electrically conductive ink, a layer of white ink having an outline corresponding to the ink image to be printed on the film.

18. The method according to claim 17, further comprising cutting through all layers of the ink and the film to provide a printed film having a shape.

19. The method according to claim 10, further comprising:

printing a first layer, including an outline corresponding to the ink image to be printed on the film;

printing a second layer of white ink on the first layer;

printing a third layer of white ink on the second layer, wherein the layer of electrically conductive ink is a fourth layer that is printed on the third layer;

printing a fifth layer of ink, with cut-out connection points, on the fourth layer; and printing a sixth layer of ink, with cut-out connection points, on the fifth layer, wherein the ink image is printed after printing the sixth later of ink.

20. A decal assembly comprising:

a film having an image printed thereon, and having an application side, for application to a surface, and a non-application side;

a battery portion including:

a base portion having a recess, the base portion being attached to the non-application side of the film; a positive battery contact provided in and extending through a surface of the base portion to contact the non-application side of the film;

a negative battery contact provided in and extending through a surface of the base portion to contact the non-application side of the film; and a cap configured to be inserted into the recess of the base portion to secure a battery within the base portion;

a light portion attached to the non-application side, the light portion including:

a cover having a recess on a surface that is attached to the non-application side; and a light-emitting diode provided in the recess of the cover, and having a positive terminal and a negative terminal;

a layer of electrically conductive ink applied to the non-application side of the film, the layer of electrically conductive ink forming a line to connect the positive battery contact to the positive terminal of the light-emitting diode, and a line to connect the negative battery contact to the negative terminal of the light-emitting diode; and at least one additional layer of ink, the at least one additional layer of ink including a plurality of cut-out connection points, the at least one additional layer of ink extending between the cut-out connection points;

wherein the positive terminal of the light is aligned with a first cut-out connection point of the plurality of cut-out connection points, and the negative terminal of the light is aligned with a second cut-out connection point of the plurality cut-out connection points so that the at least one additional layer of ink extends between the first and the second cut-out connection points.

* * * * *